United States Patent [19]

Evans

[11] 4,030,574

[45] June 21, 1977

[54] RAIL WHEEL GRIPPERS

[75] Inventor: David Arthur Evans, Bristol, England

[73] Assignee: Strachan & Henshaw Limited, Bristol, England

[22] Filed: Jan. 7, 1976

[21] Appl. No.: 647,084

[30] Foreign Application Priority Data

May 19, 1975 United Kingdom ..... 21259/75

[52] U.S. Cl. ..... 188/62

[51] Int. Cl.[2] ..... B61K 7/08

[58] Field of Search ..... 188/35, 43, 62; 74/99 R, 105, 469

[56] References Cited

UNITED STATES PATENTS

| | | | |
|---|---|---|---|
| 1,627,137 | 5/1927 | Barr | 188/62 |
| 2,639,786 | 5/1953 | Northrop et al. | 188/62 |
| 2,779,441 | 1/1957 | Beltman et al. | 188/62 |
| 3,819,017 | 6/1974 | Noble | 188/62 |

FOREIGN PATENTS OR APPLICATIONS

| | | | |
|---|---|---|---|
| 1,499,246 | 9/1967 | France | 188/62 |
| 1,000,775 | 2/1952 | France | 188/62 |
| 755,587 | 9/1944 | Germany | 188/62 |

*Primary Examiner*—Trygve M. Blix
*Assistant Examiner*—Edward R. Kazenske

[57] ABSTRACT

A rail wheel gripper for holding or retarding a rail vehicle has opposed gripper mechanisms that engage a wheel between them. Each mechanism comprises a carrier arm for a gripper member and upper and lower pivot arms connected to the carrier arm controlling the path of movement of the gripper member. Each mechanism is so arranged, and a drive device co-operates with it, as to exhibit a mechanical advantage with increased gripping force when the opposed gripper members reach their operative positions, and a mechanical disadvantage with magnified displacement of the members when they are remote from their operative position.

15 Claims, 6 Drawing Figures

RAIL WHEEL GRIPPERS

BACKGROUND OF TE INVENTION

This invention relates to rail wheel grippers, which term is intended herein to include both holding apparatus for moving vehicles, of the kind in which one or more wheels of a vehicle running on a rail track is contacted on its opposite side faces by opposed surfaces of clamping members that are mounted separately from the vehicle and are urged inwardly towards each other by operating means so as to grip the wheel between the. Such rail wheel grippers mounted on the track may be adapted to hold a vehicle stationary in a desired location or to act as a squeeze retarder in the marshalling of rail vehicles.

It is known to construct such wheel grippers in the form of calipers, comprising two opposed arms on opposite sides of the rail and pivoted at their lower ends to swing upwardly and inwardly. Such a mechanism, however requires considerable clearance both for its instalation and for its operation, In particular, in order to grip a wheel some way above its bottom contact point with the rail, the caliper arms must be relatively long and occupy a correspondingly wide span when pivoted downwards to their rest positions, while care must be taken to ensure that there is sufficient clearance between the wide arc they sweep as they are raised and the running gear of the vehicles on which they are intended to operate.

SUMMARY OF THE INVENTION

According to the invention, there is provided a rail wheel gripper of the kind described wherein at least one of said clamping members is mounted on an upwardly extending carrier arm of a mechanism that is arranged to provide a movement path for said member upwardly and inwardly from a lower inoperative position to a raised operative position, said mechanism including mounting means for the carrier arm comprising a first or lower pivot arm having spaced pivot connections with a support and with a lower region of the carrier arm, drive means being provided for relative displacement of the carrier and pivot arms so as to increase the included angle between them as the carrier arm is raised to move said clamping member towards its operative position.

It is possible to arrange such a mechanism so that the direction of movement of the clamping member is mainly inwardly as it approaches the operative position, while as it returns to the inoperative position the final part of its direction of movement is mainly downwardly.

The gripper may also include an upper pivot arm providing a pivot support for the upper region of the carrier arm and preferably the pivot centres of the first or lower pivot arm are arranged to be substantially in line with the pivot centre of the connection between said upper pivot arm and the carrier arm when the clamping member is in its operative position.

Preferably, drive means for the mechanism are arranged to act on the carrier arm through said lower pivot arm. /Thus, the mechanism may be arranged to be operated by a fluid pressure cylinder connected to a crank arm that has a common pivot axis with that end of the lower pivot arm spaced from the carrier arm and that is rotationally fixed relative to said pivot arm. The fluid pressure cylinder is preferably arranged to be disposed substantially perpendicular to the line of said crank arm from its pivot axis when the clamping member is in its operative positon, and the pivot connections of the carrier arm may be so spaced as to give the mechanism a mechanical advantage increasing the force applied through the clamping member by the pressure cylinder. The arrangement is preferably such that the mechanical advantage is quickly lost as the clamping member is moved back from its operative position, whereby the lowering movement is obtained with a relatively small displacement of the pressure cylinder.

Advantageously, the linkage is arranged to be disposed entirely below the level of the rail and is adapted to bring the clamping member itself below the level of the rail when moving it to the lower, inoperative position.

The invention will be more particularly described by way of example with reference to the accompanying drawings.

DESCRIPTION OF THE PREFERRED EMBODIMENTS

Figure 4:
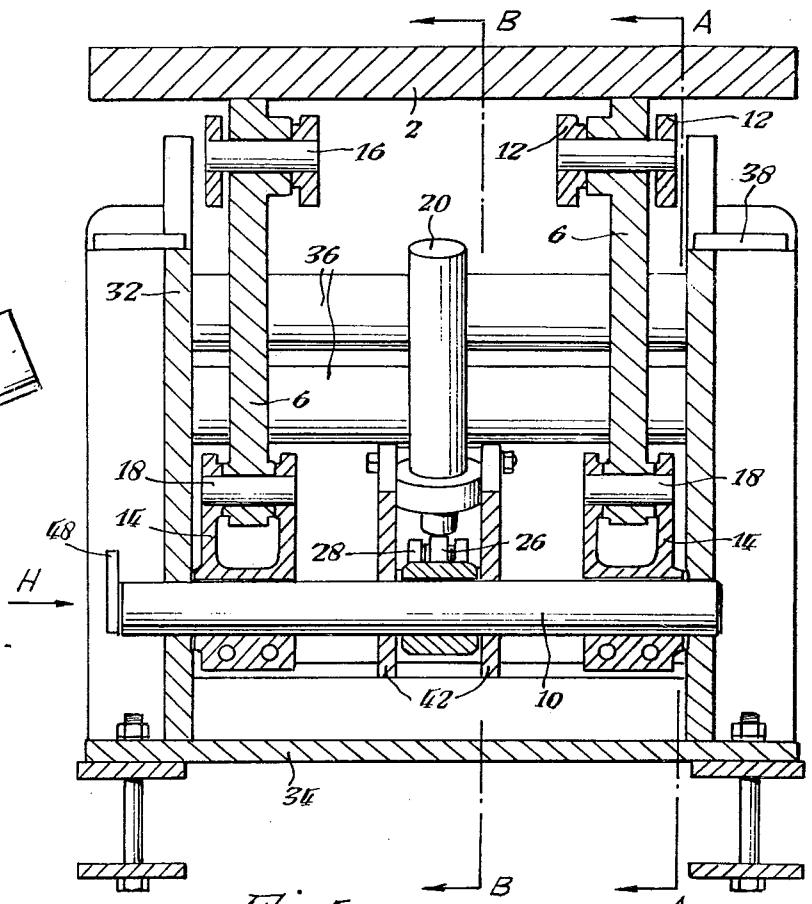
FIG. 4 is a longitudinal sectional view as seen on section lie C—C in FIG. 2 with the mechanism in the operative position.
Figure 1:
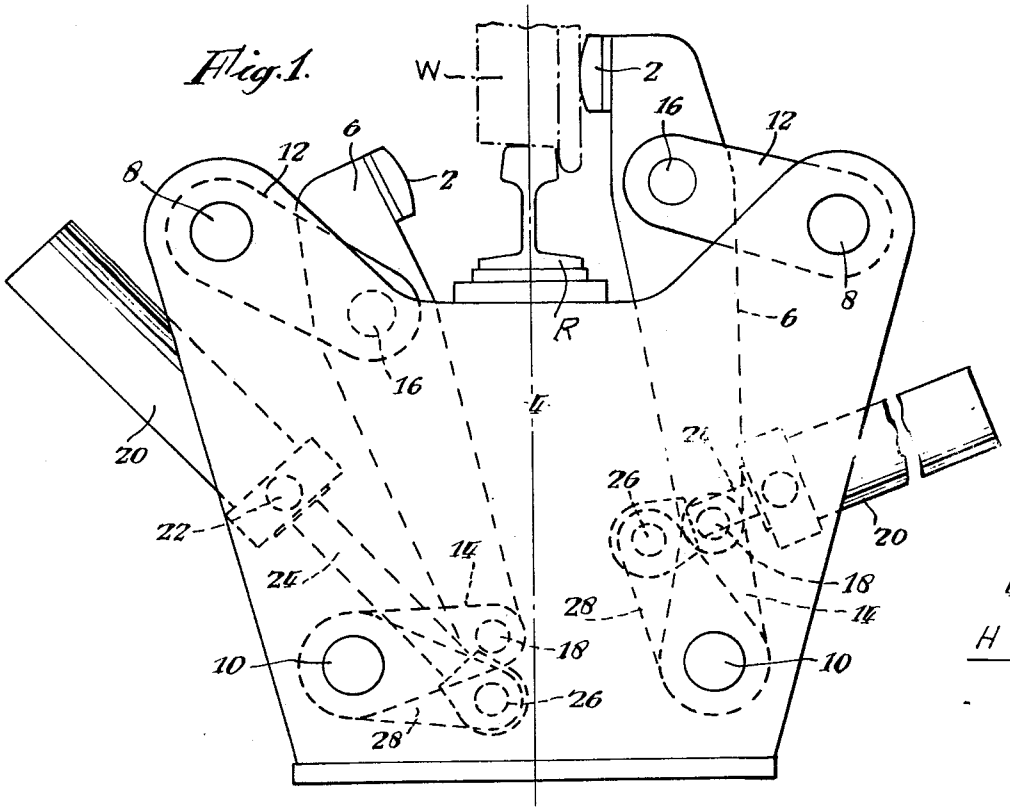
FIG. 1 is a diagrammatic illustration of a rail wheel gripper according to the invention having a structure that is symmetrical about the rail centre line but that is illustrated in the FIGURE in a retracted inoperative position to the left of the centre lie and in a raised operative position to the right of the centre line.

Referring to FIG. 1 of the drawings, the apparatus comprises a pair of horizontal gripper bars 2 that extend at right angles to the plane of the drawing and that are displaceable towards each other to grip between them the opposite sides of a wheel W of a vehicle on a rail R. The bars are so mounted on a foundation frame 4 resting below the rail that they are movable, by means of a mechanism carried by the foundation frame, between an upper operative position in which they grip the wheel between them, and an inoperative possition in which they lie below the level of the top of the rail.

Each gripper bar has a similar operating mechanism and the bars are displaced in synchronism but of course the two mechanism are disposed in mirror image to each other to move the bars towards and away from each other. Each gripper bar is secured at its ends to a pair of parallel carrier arms 6 that are each connected to upper and lower pivot shafts 8, 10 extending parallel to the gripper bar by means of upper and lower pivot arms 12, 14. The pivot arms are fixed to rotate with their respective shafts but have freely rotatable pivot connections 16, 18 with their carrier arms 6. Each mechanism has respective pairs of the upper and lower pivot arms 12, 14 adjacent opposite ends of the gripper bar. Each pair of upper arms is secured to their associated shaft in parallel disposition, as also is each pair of lower arms, so that the carrier arms of the mechanismare in their turn held parallel to each other.

Each mechanism is driven through rotation of its lower shaft 10 by a hydraulic ram 20 the body of which is pivoted at 22 to the frame 4 and the piston rod 24 of which is connected by a pivot pin 26 to a crank arm 28 fixed to the shaft 10. A common control is provided for the rams to move the mechanism in synchronism.

On the left-hand side of FIG. 1 the mechanism is shown with the gripper bar at its lowermost, inoperative position in which it is retracted so as to project little if at all above the level of the rail R, the ram 20 then being fully extended.

The lower pivot arms 14 are substantialy at right angles to the carrier arms 6 in their lowered position so that retraction of each ram 20 to rotate its shaft 10 givethe carrier arms a rising motion and because of the different angles at which the pivot arms 12, 14 lie, there is also a slight rotational component of movement bringing the gripper bar 2 inwardly towards the rail. As the rotation of the shaft continues and the lower pivot arms rotating with the shaft approach the vertical, their pivot connections 18 with the carrier arms move outwards away from the rail R and the carrier arms swing about the pivot connections 16, which are now close to their laterally innermost position, so that the movement of the gripper bar at this stage is almost entirely laterally inwards to bring it against the vehicle wheel some distance above the rail.

It is to be noted that in this latter stage of operation because of the distance between the pivot connections 16, 18 is greater than that between the upper connection 16 and the point of contact of its gripper bar with the vehicle wheel, and because the carrier arm is pivoting about the upper connection 16, the ram 20 is working at a considerable mechanical advantage i.e. the gripping force is substantially greater than the ram working force. Moreover, as is clear from the illustration in the right-hand part of Fig. 1, the gripping force applied to the wheel will not be diminished by any slight change of position of the contacted surfaces of the wheel laterally of the rail, nor will the height of the point of contact vary significantly so that the arrangement is not sensitive to minor dimensional differences or misalignments which might often be present in the rail and the vehicle wheels.

It is also to be noted that when the ram is extended to release the gripper bars, after the initial disengagement from the gripped wheel when the ram and its crank arm 28 are substantially at right-angles to each other, the descent of the gripper bars is increasingly rapid in relation to the ram piston movement until, as the final retracted position shown in the left-hand half of FIG. 1 is approached, a given increment of extension of the ram produces a substantially greater downwards movement of the gripper bar. This is because the relative movement between the ram and its crank arm 28 towards alignment with each other at this stage, giving a reducing acute angle between them, produces an increasingly magnified angular movement of the lower drive shaft 10 for a given increment of the ram piston movement. In effect, the change of mechanical advantage between operative and inoperative positions in the illustrated example means that a movement ratio of 3:1 between cylinder movement and horizontal movement of the gripper bar in the operative position (and the corresponding amplification of the force applied) becomes a ratio of 1:2 in the inoperative position, i.e. a six-fold change.

Because of the magnification of the ram movement obtained as the gripper bar descends, it is possible, without relying on large and cumbersome drive means, to obtain a relatively large displacement of the gripper bars between their operative and inoperative positions. This give the opportunity for the operative position to be located at a relatively high lvel on the vehicle wheel while still allowing the gripper bars to retract to near or even below thre rail level so as to avoid fouling low-slung parts of a passing vehicle, such as a locomotive cow-catcher. The illustrated mechanism projects up to 150 mm above rail level when raised and can be retracted below rail level if required. Despite this large vertical movement the outward throw of the mechanism is relatively limited and its lateral space requirement s are correspondingly small.

In the embodiment shown in FIGS. 2 to 6, parts already described are given the same reference numbers. The foundation frame 4 comprises flanged end plates 32 connected by a base plate 34 and three tubular ties 36. The rail R rests on pads 38 on the end plates 32 of the frame and in each mechanism the lower and upper pivot shafts 8, 10 extend between the end plates 32. The pairs of upper and lower pivot arms 12, 14 are keyed to their respective shafts 8, 10 at the remote ends of the shafts adjacent the end plates, as in FIG. 1, and the carrier arms 6 are pivoted at 16 and 18 respectively to the upper and lower pivot arms 12, 14 to carry the gripper bars 2 on their upper ends a short distance above the upper pivot connections 16. The upper pivot shafts 8 are mounted on the end plates 32 through eccentrics 40 which may be of the commercially available "Ringfeder" form, for compensation of manufacturing and fitting variations.

At a central region of the shafts 10 a pair of mounting plates 42 are supported on and extend between the shafts. The plates carry the respective rams 20 for operating the gripper bar mechanism, the rams being mounted on the plates by pivots 22 on the ram cylinders. The piston rod 24 of the ram of each mechanism is connected by its pivot pin 26 to a pair of the crank arms 28 that are keyed to the drive shaft 10. The operation of the mechanisms by their rams is entirely analogous to that described with reference to FIG. 1, although now the rams are mounted so that they always remain with the lateral extent of the foundation frame.

It may be seen that by supporting the rams on the mounting plates 42 that are themselves supported on the lower pivot shafts 10 immediately adjacent the drive cranks 28 of the rams, the bending stresses on the shafts canbe limited and it is not necessary to strengthen the foundation frame 2 to carry and support the rams. The arrangement also assists manufacture since, being otherwise unrestrained, the mounting plates will align themselves on the shafts 10.

Figure 6:
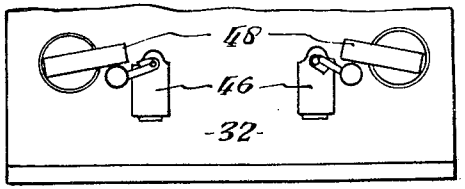
Figure 2:
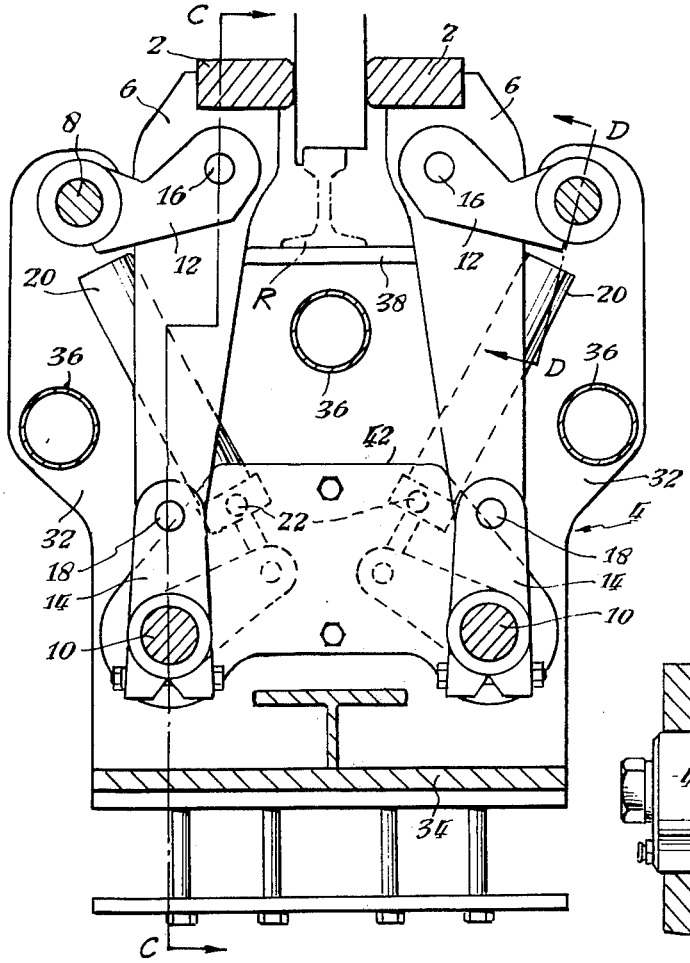
FIGS. 2 and 3 are transverse sectional views of another rail wheel gripper according to the invention, as seen on section A—A and B—B respectively in FIG. 4, the mechanism beig in its operative position in FIG. 2. and its inoperative position in FIG. 3.
Figure 5:
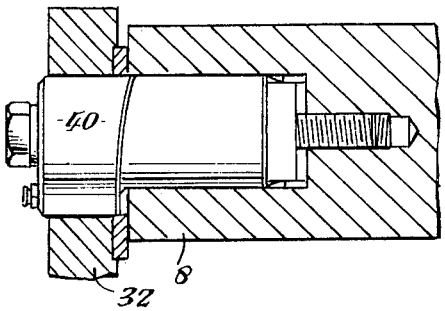
FIG. 5 is a partial sectional view on the section line D—D in FIG. 2, and of the arrow H in FIG. 4.
Figure 3:
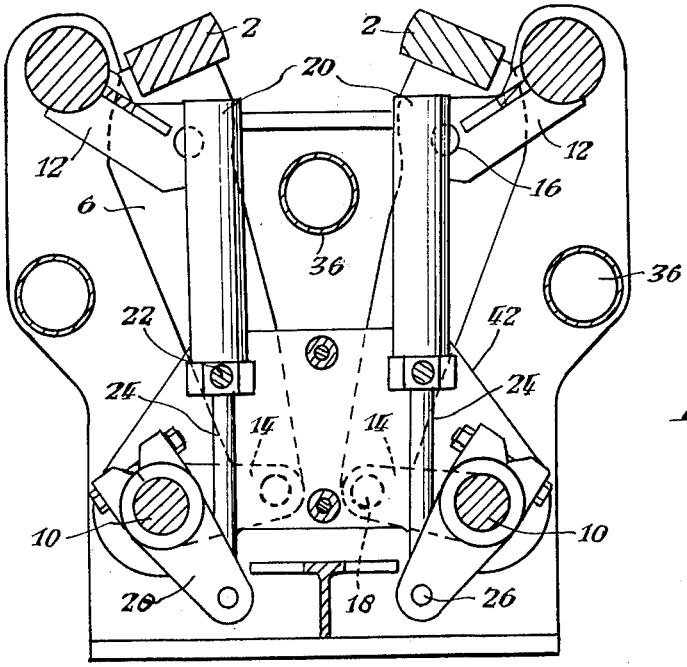

To provide a remote indication of engagement, a hydraulic pressure switch (not shown) is provided in the line to the rams, while to indicate retraction electrical limit switches 46 are arranged to be actuated by respective strikers 48 on the lower shafts 10. In FIG. 6, this arrangement is shown in the end position with the switches tripped.

The lower shafts 10 are advantageously designed to be stiff to ensure load-sharing between both link arms driven by each ram. This can also allow a number of units of the form described to be linked in tandem, and with the upper and lower shafts 8, 10 coupled, to operate together, possibly for providing a composite unit of sufficient length to act as a rail vehicle retarder or as a multiple location positioner. The coupling of the lower shafts through which the mechanisms are driven will keep the individual units in synchronism due to their stiffness and also due to the fact that the final operative position of a gripper bar is not unduly sensitive to the precise angular position reached by its lower shaft i.e. because the arms 6, 14 are then substantially in line, some 10° to 15° rotation of their shaft 10 will not materially alter the force applied.

It will be appreciated that many modifications of the described arrangements can be made within the scope of the present invention. Thus, while the four-bar mechanism illustrated provides, in a relatively compact manner, a high gripping force and rapid retraction from a simple pressure cylinder actuation, it is possible to obtain those advantage with other specific constructuions. Also, although the illustrated constructons are symmetrical arrangements, which will normally be both convenient and desirable, it is possible for a rail gripper according to the invention to employ a conventional mechanism for one clamping member and to have a mechanism such as those described only for the opposed clamping member.

What I desire to claim and secure by Letters Patent is:

1. A rail wheel gripper for use with at least one wheel of a rail vehicle running on a rail of a track for the vehicle, and comprising opposed gripper members in the region of the rail track on opposite sides of said rail, respective mechanisms carrying said gripper arms, a base structure having fixed pivot supports for said mechanisms, each mechanism comprising upper and lower pivot arms, pivotal connections between said arms and said pivot supports of the base structure, a further pivotal connection on each pivot arm spaced from said connections, an upwardly extending carrier arm mounted on said further pivotal connections of the upper and lower pivot arms of the respective mechanism, the gripper member being mounted on an upper region of said carrier arm, drive means connected to the respective mechanisms for displacing the respective gripper members in synchronism upwardly and inwardly from a lower inoperative position to an upper operative position, the displacement of each gripper member to its operative position being arranged to occur with movement of the pivot connections between the upper pivot arm and the carrier arm of both mechanisms inwardly towards each other and with movement of the pivot connection between the lower pivot arm and the carrier arm of each mechanism towards a position close to the line joining the fixed pivot connection of said lower arm and the pivot connection between the upper pivot arm and the carrier arm of the respective mechanism.

2. A rail gripper for use upon at least one wheel of a rail vehicle running on a rail of a track for the vehicle, and comprising, in combination, opposed clamping members adapted to respectively grip opposite sides of said wheel, a mounting mechanism for each clamping member, support means for each said mounting mechanism each said mounting mechanism comprising, an upwardly extending carrier arm having an upper region on which said clamping member is secured and a lower region remote from said upper region, means pivotally connecting said support meand to said carrier arm lower region comprising a first pivot arm having respective pivot axes on the support and the carrier arm lower region, guide means separate and independent of said firs pivot arm and pivotally connected to said support and said carrier arm upper region said guide means having a pivot axis on the carrier arm upper region, said carrier arm having an axis defined by and extending between said upper and lower region pivot axes, said first pivot arm having an axis defined by and extending between the pivot axes thereof, said carrier arm axis and first pivot arm axis together defining an included angle, said carrier arm and said first pivot arm being relatively displaceable to increase said included angle from a first inoperative position wherein said clamping member is lowered to substantially the level of said rail to a second operative position wherein said clamping means is raised to engage said wheel, and drive means connected to said mechanism for displacing said carrier arm and said first pivot arm.

3. The rail wheel gripper according to claim 2 wherein said drive means act on the carrier arm through said first pivot arm.

4. The aril wheel gripper according to claim 2 wherein said guid means for the carrier arm comprises a second pivot arm, having pivot connections with said support spaced from said connection with said upper region of the carrier arm, said second pivot arm extending substantially transversely of the carrier arm when said clamping member is in its operative position.

5. The rail wheel gripper according to claim 4 wherein said drive means comprises a fluid pressure cylinder disposed within the outer lateral limit of the mounting mechanism of the clamping member and said pressure cylinder is arranged to remain substantially with said limit over the range of movement of said mechanism.

6. The rail wheel gripper according to claim 5 wherein said fluid pressure cylinder is pivotable connected to said support and is rotatable thereabout on displacement of said mounting mechanism.

7. The rail wheel gripper according to claim 4 wherein the spaced pivot connections of the first pivot arm and the pivot connection between the carrier arm and the second pivot arm are disposed substantially in line when the clamping member is in its operative position.

8. The rail wheel gripper according to claim 7 wherein said drive means act on the carrier arm through said first pivot arm and the carrier arm moves about its pivot connection with said second pivot arm when the clamping member is in the operative position, the space between said pivot connections on the carrier arm being greater than the space between the pivot arm pivot connections of said first pivot arm whereby the force applied through the clamping member by the first pivot arm is increased in said operative position of the clamping member.

9. The rail wheel gripper according to claim 2 including a crank element connected to the drive means to operate said mechanism, said crank element being pivotable about the axis of said pivot connection between the first pivot arm and the support and being held in fixed relation to said first pivot arm.

10. The rail wheel gripper according to claim 9 wherein said drive means comprises a fluid pressure cylinder having a longitudinal axis directed substantially perpendicular to the line between said crank element and said pivot connection axis between the first pivot arm and the support when said clamping member is in its operative position.

11. The rail wheel gripper accoding to claim 2, wherein the first pivot arm is arranged in the inoperative position substantially perpendicular to said carrier arm.

12. A rail wheel gripper for use upon at least one wheel of a rail vehicle, running on a rail of a track of the vehicle, and comprising, in combination, opposed clamping members adapted to respectively grip opposite sides of said fwheel, a mounting mechanism for each clamping member, a support for each said mounting mechanism each said mounting mechanism comprising upwardly extending carrier arms spaced along the length of the clamping member, said carrier arms having an upper region on which said clamping member is secured and a lower region, respective similarly spaced pairs to upper and lower pivot arms connecting said carrier arms to said support, the upper pivot arms having respective pivot connections with the support and the upper region of the carrier arms and the lower pivot arms having respective pivot connections with the support and the lower region of the carrier arms, a common shaft pivoted in said support providing the pivot connection between said support and lower pivot arms, and having the lower pivot rotationally fixed thereto, drive means for displacing the clamping member between a raised operative position and a lowered inoperative position, a crank element fixed to said common shaft intermediate the lower pivot arms and connecting drive meas thereto, said carrier arms and said lower pivot arms defining an included angle when the clamping member is in its inoperative position, said drive means causing relative displacement between said carrier arms and said pivot arms so as to increase the included angle between them and moving the clamping member upwardly to a raised operative position engaging said vehicle wheel.

13. The rail gripper according to calim 12 wherein said mounting mechanism are arranged in opposition to each other and comprise a mounting arrangement supported on the respective common shafts of the mechanism, the drive means of the mechanism being attached to said mounting arrangement to act between said arrangement and the respective mechanisms.

14. The rail wheel gripper according to claim 13 wherein a common structure provides said support for both said mounting mechanisms, said common structure being provided with said pivot connections for the first and second fpivot arms spaced form their connection with the carrier arms.

15. The rail wheel gripper according to claim 12 wherein said mounting mechanisms are displaceable to lower the clamping members at least to the level of the rail when moving to the inoperative position.

* * * * *